US010005592B2

(12) United States Patent
Takigawa

(10) Patent No.: US 10,005,592 B2
(45) Date of Patent: Jun. 26, 2018

(54) CHILD-RESISTANT ZIPPER AND PACKAGING BAG INCORPORATING SAID ZIPPER

(71) Applicant: Takigawa Corporation Japan, Chiba Perfecture (JP)

(72) Inventor: Hiroyuki Takigawa, Chiba Prefecture (JP)

(73) Assignee: Takigawa Corporation Japan, Chiba Prefecture (JP)

( * ) Notice: Subject to any disclaimer, the term of this patent is extended or adjusted under 35 U.S.C. 154(b) by 178 days.

(21) Appl. No.: 14/710,210

(22) Filed: May 12, 2015

(65) Prior Publication Data

US 2016/0101904 A1 Apr. 14, 2016

(30) Foreign Application Priority Data

Oct. 9, 2014 (JP) ..... 2014-207812

(51) Int. Cl.
*B65D 33/25* (2006.01)

(52) U.S. Cl.
CPC ..... *B65D 33/2566* (2013.01)

(58) Field of Classification Search
CPC ..... B65D 33/2566; B65D 33/2541; B65D 33/2508; A44B 19/42
See application file for complete search history.

(56) References Cited

U.S. PATENT DOCUMENTS 4,817,188 A * 3/1989 Van Erden ..... B65D 33/2541 24/287
5,017,021 A * 5/1991 Simonsen ..... B65D 33/2541 383/63
5,063,639 A * 11/1991 Boeckmann ..... B29C 65/08 156/66
5,558,613 A * 9/1996 Tilman ..... B65D 33/2541 493/212
5,878,468 A 3/1999 Tomic et al.
5,972,396 A * 10/1999 Jurgovan ..... B65D 33/2533 206/810

(Continued)

FOREIGN PATENT DOCUMENTS

JP 2001-322652 A 11/2001
JP 3655104 B2 6/2005

*Primary Examiner* — Jason W San
(74) *Attorney, Agent, or Firm* — Cesari and McKenna, LLP

(57) ABSTRACT

A zipper unit for a packaging bag is provided comprising a sealing zipper to seal the packaging bag in a ally sealed state. The sealing zipper is configured to be opened with the opening operation of the packaging bag. The zipper unit also comprises a locking zipper having a fit-engagement strength stronger than the fit-engagement strength of the sealing zipper. A releasing cutout portion is provided in a part of a fit-engagement body of the locking zipper. The locking zipper is configured to be opened from the releasing cutout portion. The locking zipper may be situated as the first zipper at the opening of the packaging bag to prevent the packaging bag from being opened, for example, by a child. The sealing zipper may be provided as the second zipper closest to the inside of the packaging bag and accessible by release or opening of the locking zipper.

5 Claims, 5 Drawing Sheets

(56) References Cited

U.S. PATENT DOCUMENTS 6,004,032 A * 12/1999 Kapperman ..... B65D 33/2516 24/585.12
6,186,663 B1 * 2/2001 Ausnit ..... B65D 31/10 24/30.5 R
6,389,651 B2 * 5/2002 Johnson ..... B65D 33/2508 24/30.5 R
6,550,965 B2 * 4/2003 Shaffer ..... B29C 65/02 24/585.12
6,691,383 B2 * 2/2004 Linton ..... B65D 33/2516 156/66
7,322,747 B2 * 1/2008 Borchardt ..... B65D 33/2541 24/30.5 R
7,437,805 B2 * 10/2008 Berich ..... B65D 33/01 24/399
7,574,781 B2 * 8/2009 Ackerman ..... B65D 33/2541 24/30.5 R
7,784,160 B2 * 8/2010 Dais ..... B65D 33/2508 24/585.12
7,866,011 B2 * 1/2011 Greco ..... B65D 33/2508 24/399
7,886,412 B2 * 2/2011 Dais ..... B65D 81/2023 24/399
8,549,713 B2 * 10/2013 Anzini ..... B65D 33/2516 24/30.5 R
8,727,620 B2 * 5/2014 Dais ..... B65D 33/2508 24/399
9,102,453 B2 * 8/2015 Koenigkramer ..... B65D 31/10
2005/0271308 A1 * 12/2005 Pawloski ..... B65D 33/2508 383/63
2006/0111226 A1 * 5/2006 Anzini ..... B65D 33/2508 493/214
2006/0168776 A1 8/2006 Dais et al.
2008/0232722 A1 * 9/2008 Pawloski ..... B65D 33/2508 383/64
2009/0097781 A1 * 4/2009 Tang ..... B65D 33/2566 383/61.2
2009/0214141 A1 * 8/2009 Borchardt ..... B65D 33/2541 383/63
2010/0014786 A1 * 1/2010 Pawloski ..... B65D 33/01 383/59
2010/0299881 A1 * 12/2010 Borchardt ..... B65D 33/255 24/30.5 R
2011/0162329 A1 * 7/2011 So ..... B65D 33/2533 53/469
2011/0311167 A1 * 12/2011 Hall ..... B65D 33/2566 383/61.2
2012/0045151 A1 * 2/2012 Eouzan ..... B65D 33/2541 383/42
2012/0195533 A1 * 8/2012 Mead ..... B65D 33/2566 383/203
2013/0089647 A1 * 4/2013 Baret ..... B65D 33/2508 426/412
2014/0093195 A1 * 4/2014 Dais ..... B65D 33/28 383/65
2014/0161374 A1 * 6/2014 Septien Rojas .... B65D 33/2508 383/63
2016/0318691 A1 * 11/2016 Cui ..... B65D 33/2508
2017/0081085 A1 * 3/2017 Ausnit ..... B65D 33/2525

* cited by examiner

CHILD-RESISTANT ZIPPER AND PACKAGING BAG INCORPORATING SAID ZIPPER

CROSS-REFERENCE TO RELATED APPLICATIONS

This application claims the benefit of Japanese Application No. 2014-207,812, filed on Oct. 9, 2014, the content of which is hereby incorporated by reference in its entirety.

BACKGROUND OF THE INVENTION

Field of the Invention

The present invention relates to a child-resistant zipper and a packaging bag incorporating such a zipper to prevent unwanted opening of the zipper, for example, by a child, etc., but which is readily opened by predetermined procedures.

Background Information

The term "child-resistant" refers to a function/mechanism by means of which it is possible to prevent an object from being easily manipulated, for example, by a child or other similar individual. Due to this function, a child is hindered or prevented, for example, from tampering with a lighter, and from easily opening a container of medicine, etc.

On the other hand, a packaging bag including a sealing zipper can be easily opened and closed, and may be used for various packaging purposes. For example, the packaging bag disclosed in Japanese Patent Application No. 3655104 is suitable, in particular, for the packaging of food to be cooked by heating by a microwave oven, etc. In this case, two zippers are provided in parallel at the opening of the bag body. Only one of the zippers is opened on heating, and the open zipper is closed when the food is to be stored after the completion of the heating, whereby it is possible to perform the heating and the storage thereafter through easy operational procedures.

Although there has been proposed a zipper suitable for the packaging of food to be cooked by heating as disclosed in Japanese Patent Application No. 3655104, no zipper has been proposed as of yet which is provided with a child-resistant function to hinder or prevent its opening by a child.

Thus, in a case where something which has to be prevented from being accidentally ingested by a child is included in a packaging bag equipped with a zipper, control of the packaging bag requires careful monitoring. Thus, there is a need for a child-resistant zipper for use in a packaging bag that is difficult for a child to open.

The present invention has been made with a view toward solving at least one of the above problems.

SUMMARY OF THE INVENTION

In a first aspect according to the present invention, there is provided a zipper unit equipped with a pair of adhesion band members for adherence to opposing inner side surfaces of an opening of a packaging bag, and a fit-engagement body configured to releasably engage opposing surfaces of the adhesion band members, wherein the fit-engagement body comprises a sealing zipper which releasably engages the inner side surfaces of the opening of the bag in a sealed state which is released with the opening operation of the opening of the packaging bag; and a locking zipper comprising a first fit-engagement portion with at least one fit-engagement protrusion, and a second fit-engagement portion with at least one fit-engagement recess, wherein the first and second fit-engagement portions are on opposing surfaces of the fit engagement body and the fit-engagement protrusion and recess are adapted to releasably engage the first and second fit-engagement portions in a locked state, the locking zipper also comprising a releasing cutout portion provided in the fit-engagement body, wherein engagement of the fit-engaging protrusion and recess is released from the releasing cutout portion to unlock the locking zipper, wherein the locking zipper and the sealing zipper are arranged on the inner side surfaces of the opening of the bag.

In one embodiment, there is provided a zipper unit, wherein, in the locking zipper, a plurality of releasing cutout portions are alternately provided along the first and second fit-engagement portions between protrusions and recesses, respectively, and wherein the locked state of the locking zipper is released when engaged fit-engagement protrusions and fit-engagement recesses are caused to slide oppositely toward an adjacent releasing cutout portion.

In another embodiment, there is provided a zipper unit, wherein, in the locking zipper, the releasing cutout portion is provided at an end portion of the fit-engagement body, and the locked state of the locking zipper is released by inserting a finger into the releasing cutout portion.

In another aspect of the invention, there is provided a packaging bag with a zipper unit equipped with a pair of adhesion band members adhered to inner opposing side surfaces of an opening of the packaging bag, and a fit-engagement body configured to releasably engage opposing surfaces of the adhesion band members, wherein the fit engagement body comprises: a sealing zipper which releasably engages the inner side surfaces of the opening P1 in a sealed state which is released with the opening operation of the opening of the packaging bag; and a locking zipper comprising a first fit-engagement portion with at least one fit-engagement protrusion, and a second fit-engagement portion with at least one fit-engagement recess, wherein the first and second fit-engagement portions are on opposing surfaces of the fit engagement body and the fit-engagement protrusion and recess are adapted to releasably engage the first and second fit-engagement portions in a locked state, the locking zipper also comprising releasing cutout portions provided in the fit-engagement body, wherein engagement of the fit-engaging protrusion and recess is released from a releasing cutout portion, wherein the releasing cutout portions are alternately provided along the first and second fit-engagement portions between protrusions and recesses, respectively, and the locked state of the locking zipper is released when engaged fit-engagement protrusions and recesses are caused to slide oppositely toward the adjacent releasing cutout portion, and wherein the locking zipper is provided as the first zipper at the opening of the packaging bag, and the sealing zipper is provided as the second zipper accessible when the locking zipper is released.

In an embodiment, there is provided a zipper packaging bag provided with a zipper unit equipped with a pair of adhesion band members adhered to inner opposing side surfaces of an opening of a packaging bag, and a fit-engagement body configured to releasably engage opposing surfaces of the adhesion band members, wherein the fit engagement body comprises: a sealing zipper which releasably engages the inner side surfaces of the opening in a sealed state which is released with the opening operation of the opening of the packaging bag; and a locking zipper comprising a first fit-engagement portion with at least one fit-engagement protrusion, and a second fit-engagement portion with at least one fit-engagement recess, wherein the first and second fit-engagement portions are on opposing surfaces of the fit engagement body and the fit-engagement protrusion and recess are adapted to releasably engage the first and second fit-engagement portions in a locked state, the locking zipper also comprising a releasing cutout portion provided in the fit-engagement body, wherein engagement of the fit-engaging protrusion and recess is released from the releasing cutout portion, wherein the releasing cutout portion is provided at a longitudinal end portion of the fit-engagement body, the locked state of the locking zipper is released by inserting a finger into the releasing cutout portion, and wherein the locking zipper is provided as the first zipper at the opening of the packaging bag, and the sealing zipper is provided as the second zipper accessible by the release of the locking zipper.

The zipper unit according to an embodiment of the present invention, for use in a packaging bag, incorporates a locking zipper which has a fit-engagement strength that is greater or stronger than the fit-engagement strength of the sealing zipper. The locking zipper includes a releasing cutout portion formed within part of the fit-engagement body, and the locked state of the locking zipper is released from the releasing cutout portion, whereby, even when the opening of the packaging bag is opened at the sealing zipper, the locking zipper is not released or unlocked, but can be opened from the releasing cutout portion making the opening of the locking zipper difficult for opening by a child, or other similar individual.

The locking zipper is formed such that protrusions and recesses formed in the fit-engagement body and releasing cutout portions are alternately provided along the fit-engagement body, and that fit-engaged protrusions and recesses of the fit-engaged fit-engagement body are released from engagement when respectively caused to slide oppositely toward the adjacent releasing cutout portion. Thus, if one tries to open the packaging bag, the locking zipper will not open, thereby hindering opening of packaging bag by a child.

The releasing cutout portion may be provided at a longitudinal end portion of the fit-engagement body, and the fit-engaged portions of the fit-engagement body are opened or released from engagement by inserting a finger into the releasing cutout portion. Thus, if one tries to open the packaging bag, the locking zipper will not open. As a result, the packaging bag hinders opening by a child.

It is possible to provide various packaging bags with a locking zipper as herein described to render the opening of the packaging bags to be child-resistant. Furthermore, when the locking zipper is released from its locked state and opened, the sealing zipper is readily opened through the opening operation of the packaging bag in a normal manner.

BRIEF DESCRIPTION OF THE DRAWINGS

The invention description below refers to the accompanying drawings, of which.

DETAILED DESCRIPTION

Figure 1:
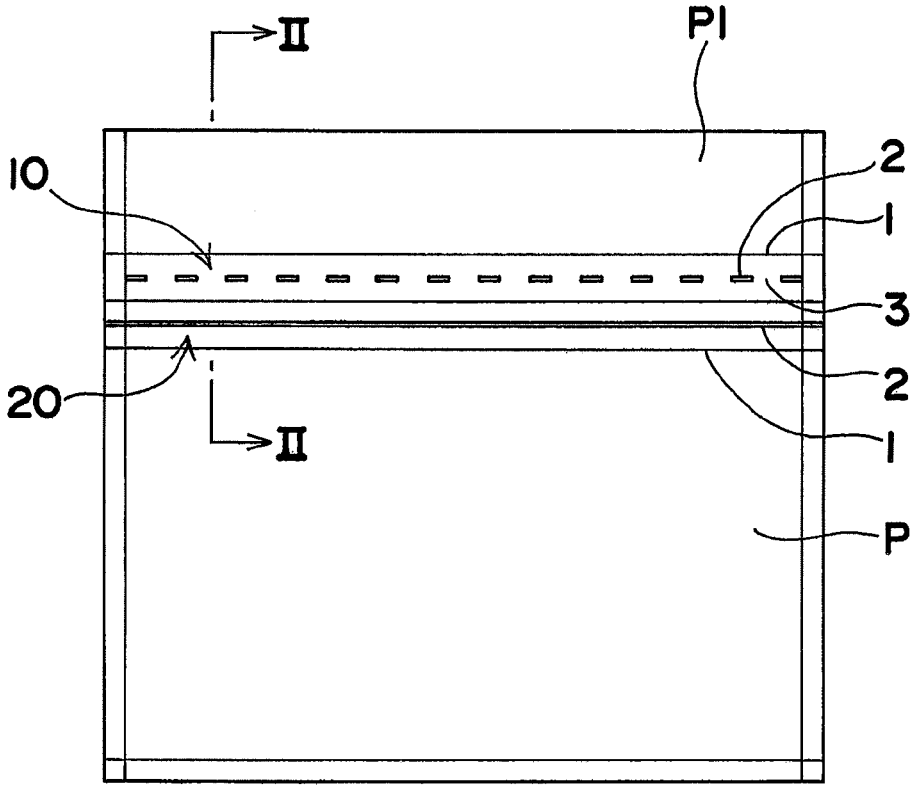
FIG. 1 is a front view of an embodiment of the present invention.
Figure 4:
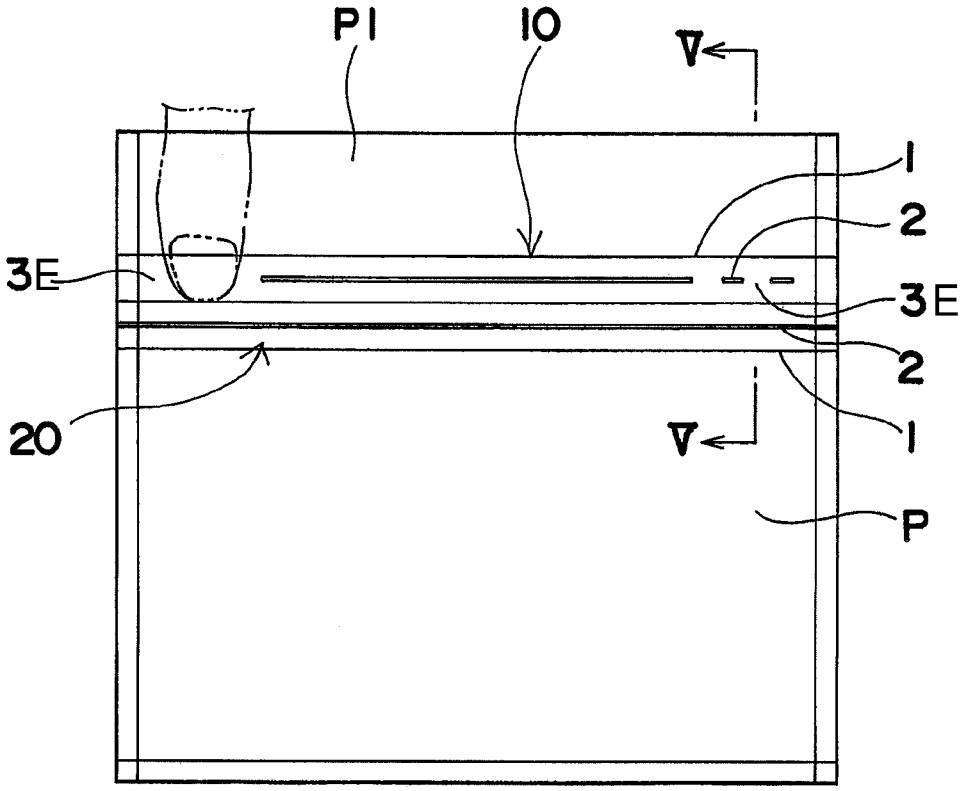
FIG. 4 is a front view of another embodiment of the present invention.

In one embodiment of the present invention, a zipper unit, for example, a polyethylene or polypropylene zipper unit, is provided having a fit-engagement body 2 comprising first and second fit-engagement portions which may be releasably fit-engaged; basically, the zipper is formed by the adhesion band members 1 and the fit-engagement portions of body 2 protruding therefrom; due to the fit-engagement strength of the fit-engagement portions of body 2, the opening P1 of the packaging bag P may be releasably engaged (See FIGS. 1 and 4).

The adhesion band members 1 are band-like members for adherence to the opposing inner sides of the opening P1 of, for example, a packaging bag P, e.g. a polyethylene or polypropylene bag (See FIG. 1). The first fit-engagement portion of fit-engagement body 2 comprises fit-engagement protrusions 2A and the second fit-engagement portion comprises fit-engagement recesses 2B provided on the opposing surfaces of the fit-engagement body 2 and permit the band-like bodies 1 to be fit-engaged with each other.

In an embodiment of the present invention, a zipper unit is provided comprising two kinds of zippers: the locking zipper 10 and the sealing zipper 20 (See FIGS. 1 and 4). The sealing zipper 20 is a zipper for releasably engaging the opposing inner side surfaces of the opening P1 of bag P to each other in a sealed state; it is a zipper of a general type in which the fit-engaged fit-engagement body 2 (e.g. the engagement of first and second portions of the fit-engagement body 2) is opened or released with the opening operation of the opening P1 of the packaging bag P.

The locking zipper 10 is a zipper in which the fit-engagement the first and second portions of the fit-engagement body 2 is stronger than that of the sealing zipper 20; it is provided so as to be difficult to open through the opening operation of the opening P1 of the packaging bag P. Furthermore, at least one releasing cutout portion 3 is provided in a part of the fit-engagement body 2 (See FIGS. 1 and 4). This releasing cutout portion 3 is provided so as to open or release the locked state of the locking zipper 10 (e.g. the engagement of first and second portions of the fit-engaged fit-engagement body 2 by the locking zipper 10).

Figure 2:
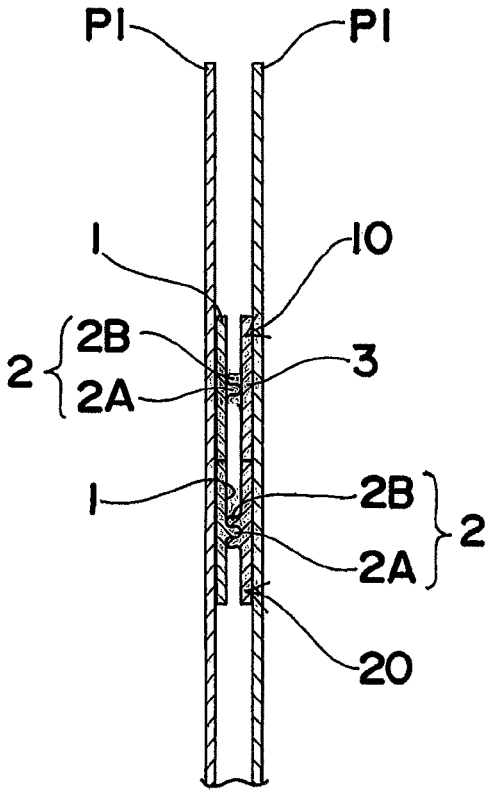
FIG. 2 is a side sectional view taken along arrow line II-II of FIG. 1.
Figure 3:
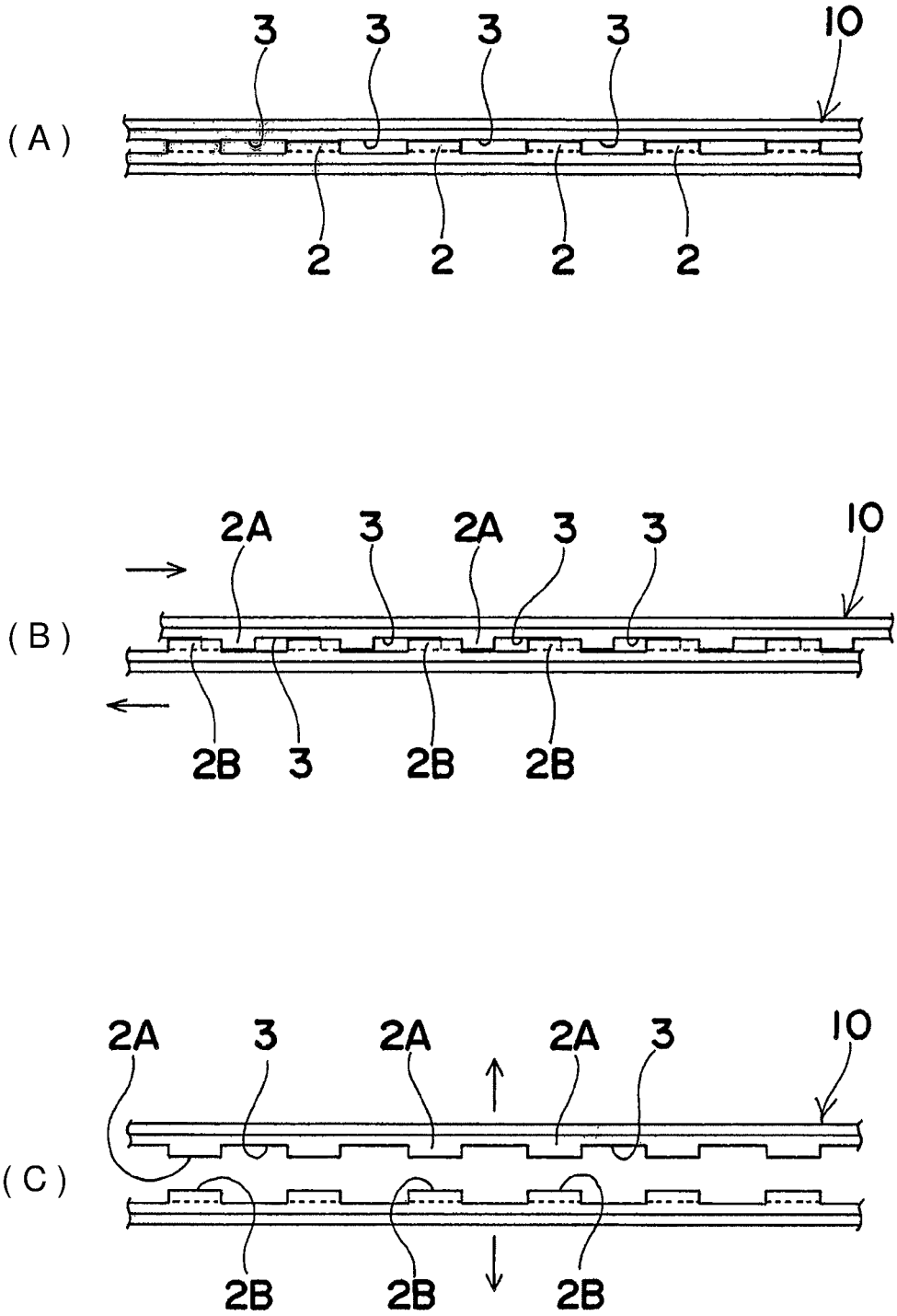
FIG. 3 is a side sectional view showing a lock structure when the opening is widened.

In the locking zipper 10 shown in FIGS. 1 through 3, the fit-engagement portions of body 2 comprises a plurality of releasing cutout portions 3 alternately provided with fit-engagement recesses 2B and protrusions 2A along the longitudinal direction of the fit-engagement body 2 (See FIG. 3(A)). And, when the fit-engagement protrusion 2A and the fit-engagement recess 2B in the fit-engaged state are caused to slide oppositely in the direction of the adjacent releasing cutout portion 3 (See FIG. 3(B)), the fit-engagement body 2 is opened or released from its locked state (See FIG. 3(C)). Although a large number of releasing cutout portions 3 are provided along the fit-engagement body 2 in the drawings, the number and interval of the releasing cutout portions 3 are not restricted to those shown but can be set arbitrarily from at least 1 to a plurality.

Figure 5:
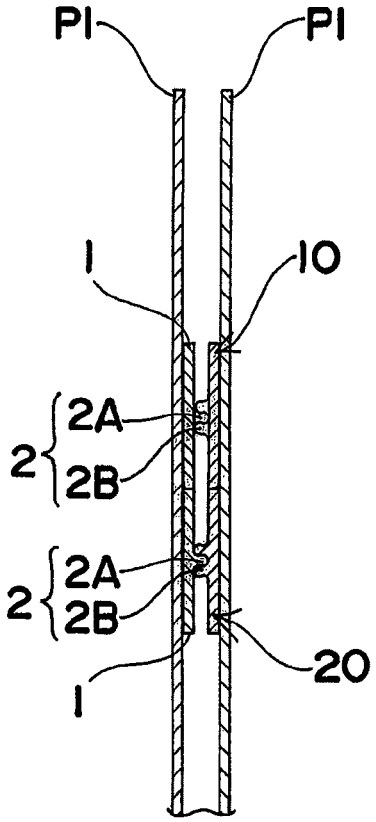
FIG. 5 is a side sectional view taken along arrow line V-V of FIG. 4.

In the locking zipper 10 shown in the embodiment of FIGS. 4 and 5, the releasing cutout portion 3E is provided at a longitudinal end portion of the fit-engagement body; by inserting a finger into the releasing cutout portion 3E, the fit-engagement state of the fit-engagement body 2 is released. That is, by inserting a fingertip into the releasing cutout portion 3E, it is possible to forcibly open, e.g. disengage the fit-engagement body 2 by disengaging the engagement between recesses and protrusions of first and second fit engagement portions. Although, in the shown example, the releasing cutout portions 3E are provided at both longitudinal end portions of the fit-engagement body 2, it is also possible to provide the releasing cutout portion 3E solely at one side of the end portions. Furthermore, apart from forming the releasing cutout portion 3E in a width allowing insertion of a fingertip, it is also possible to form the releasing cutout portion 3 by cutting out a part of the fit-engagement body 2. Thus, a releasing cutout portion 3E permits opening of the fit-engagement body 2 with a fingertip, or other means.

The packaging bag P of an embodiment of the present invention is a packaging bag P provided with zippers releasably engaging the opening P1 by the fit-engagement strength of the fit-engagement body 2 (See FIGS. 1 and 4). That is, the present invention provides a zipper unit and packaging bag P incorporating a zipper unit comprising a locking zipper 10 and a sealing zipper 20 at the opening P1.

Thus, the locking zipper 10 may be selected from a locking zipper as defined herein, such as a locking zipper 10 shown in FIG. 1 or a locking zipper 10 shown in FIG. 4. Regarding the sealing zipper 20, any type of conventionally used sealing zippers are sufficient.

Preferably, by providing the locking zipper 10 as the first zipper at the opening P1 of the packaging bag P, the opening of the packaging bag by a child is hindered (See FIGS. 1, 2 and 5). Furthermore, by providing the sealing zipper 20 as the second zipper, closest to the inside P2 of the packaging bag P, and accessed only by opening or releasing locking zipper 10, the packaging bag P is sealed. Although, in the shown examples, the locking zipper 10 and the sealing zipper 20 are separately provided, these may also be provided integrally.

The zipper unit described herein is applicable to all packaging bags in which both a locking zipper 10 and the sealing zipper 20 are concurrently used at the opening P1. Thus, in addition to the flat bag as shown in the drawings, the packaging bag of the present invention may be gusseted bags of various types, including, but limited to, bottom gusset or side gusset bags, with or without a flat-bottom configuration. Further, regarding the configuration, structure, size, contents, etc., of the packaging bag P, various modifications are possible.

DESCRIPTION OF SYMBOLS

P: Packaging bag
P1: Opening
P2: the inside of the packaging bag
1: Adhesion band member
2: Fit-engagement body
2A: Fit-engagement protrusion
2B: Fit-engagement recess
3: Releasing cutout portion
10: Locking zipper
20: Sealing zipper

The invention claimed is:

1. A child-resistant zipper unit comprising a pair of adhesion band members adhered to opposing inner side surfaces of an opening of a packaging bag, and a fit-engagement body configured to releasably engage opposing surfaces of the adhesion band members, wherein the fit-engagement body comprises: a sealing zipper which releasably engages the inner side surfaces of the opening in a sealed state which is released with the opening operation of the opening of a packaging bag; and a locking zipper comprising a first fit-engagement portion with at least one fit-engagement protrusion, and a second fit-engagement portion with at least one fit-engagement recess, wherein the first and second fit-engagement portions are on opposing surfaces of the fit engagement body and the at least one fit-engagement protrusion and recess are adapted to releasably engage the first and second fit-engagement portions in a locked state, the locking zipper also comprising at least one releasing cutout portion provided in the fit-engagement body, wherein engagement of the at least one fit-engagement protrusion and recess is released by sliding laterally the first fit-engagement portion and the second fit-engagement portion in opposite directions towards the at least one releasing cutout portion to unlock the locking zipper, wherein the locking zipper and the sealing zipper are arranged in parallel on the inner side surfaces of the opening.

2. The zipper unit according to claim 1, wherein, in the locking zipper, the at least one releasing cutout portion is a plurality of releasing cutout portions, and the at least one fit-engagement protrusion and recess is a plurality of fit-engagement protrusions and recesses, the plurality of releasing cutout portions are alternately provided along first and second fit-engagement portions between the plurality of fit-engagement protrusions and recesses, respectively, and wherein the locked state of the locking zipper is released when the engaged plurality of fit-engagement protrusions and recesses are caused to slide oppositely and laterally toward an adjacent releasing cutout portion of the plurality of releasing cutout portions.

3. A zipper packaging bag provided with a zipper unit comprising a pair of adhesion band members adhered to inner opposing side surfaces of an opening of the packaging bag, and a fit-engagement body configured to releasably engage opposing surfaces of the adhesion band members, wherein the fit engagement body comprises a sealing zipper which releasably engages the inner side surfaces of the opening in a sealed state which is released with the opening operation of the opening of the packaging bag; and a locking zipper comprising a first fit-engagement portion with at least one fit-engagement protrusion, and a second fit-engagement portion with at least one fit-engagement recess, wherein the first and second fit-engagement portions are on opposing surfaces of the fit engagement body and the at least one fit-engagement protrusion and recess are adapted to releasably engage the first and second fit-engagement portions in a locked state, the locking zipper also comprising a plurality of releasing cutout portions provided in the fit-engagement body, wherein the at least one fit-engagement protrusion and recess is a plurality of fit-engagement protrusions and recesses, wherein engagement of the plurality of fit-engagement protrusions and recesses are released from the plurality of releasing cutout portions, wherein the plurality of releasing cutout portions are alternately provided along the first and second fit-engagement portions between the plurality of fit-engagement protrusions and recesses, respectively, and the locked state of the locking zipper is released when the engaged plurality of fit-engagement protrusions and recesses slide oppositely and laterally toward an adjacent releasing cutout portion of the plurality of releasing cutout portions and wherein the locking zipper is provided as a first zipper at the opening of the packaging bag, and the sealing zipper is provided as a second zipper accessible on release of the locking zipper.

4. The zipper unit according to claim 1, wherein the sealing zipper is accessed by opening the locking zipper.

5. The zipper unit according to claim 1, wherein the locking zipper and the sealing zipper are integral.

* * * * *